US008011104B2

(12) United States Patent
Masek et al.

(10) Patent No.: US 8,011,104 B2
(45) Date of Patent: Sep. 6, 2011

(54) CUTTING MEMBERS FOR SHAVING RAZORS

(75) Inventors: William Masek, North Attleboro, MA (US); Robert Smith, North Attleboro, MA (US); John L. Maziarz, Natick, MA (US); Joseph A. DePuydt, Quincy, MA (US); Ming Laura Xu, Wayland, MA (US); Craig Stephen Vickery, Reading, MA (US)

(73) Assignee: The Gillette Company, Boston, MA (US)

( * ) Notice: Subject to any disclaimer, the term of this patent is extended or adjusted under 35 U.S.C. 154(b) by 445 days.

(21) Appl. No.: 11/401,131

(22) Filed: Apr. 10, 2006

(65) Prior Publication Data

US 2007/0234577 A1 Oct. 11, 2007

(51) Int. Cl.
*B26B 21/56* (2006.01)

(52) U.S. Cl. ..... 30/346.5; 30/50; 76/104.1

(58) Field of Classification Search ..... 30/346.5, 30/346.53, 50; 76/101.1, 104.1, DIG. 8
See application file for complete search history.

(56) References Cited

U.S. PATENT DOCUMENTS

| | | | | |
|---|---|---|---|---|
| 1,672,516 | A * | 6/1928 | Drew | 72/340 |
| 2,674,039 | A | 4/1954 | De Mesquita | |
| 2,705,834 | A | 4/1955 | Lundy | |
| 3,754,329 | A | 8/1973 | Lane | |
| 3,834,017 | A | 9/1974 | Tolmie | |
| 3,834,947 | A | 9/1974 | Swoboda et al. | |
| 3,871,073 | A | 3/1975 | Nissen et al. | |
| 3,911,579 | A | 10/1975 | Lane et al. | |
| 3,938,250 | A * | 2/1976 | Perry | 30/346.57 |
| 4,167,662 | A | 9/1979 | Steen | |
| 4,302,876 | A * | 12/1981 | Emmett | 30/47 |
| 4,304,978 | A | 12/1981 | Saunders | |
| 4,389,773 | A * | 6/1983 | Nissen et al. | 30/50 |
| 4,473,735 | A | 9/1984 | Steffen | |
| 4,507,538 | A | 3/1985 | Brown et al. | |
| 4,621,424 | A * | 11/1986 | Jacobson | 30/41 |
| 4,980,021 | A | 12/1990 | Kitamura et al. | |
| 4,998,347 | A | 3/1991 | Schachter | |
| 5,010,646 | A * | 4/1991 | Neamtu | 30/50 |
| 5,224,267 | A | 7/1993 | Simms | |
| 5,347,887 | A | 9/1994 | Rosenthal et al. | |
| 5,360,495 | A | 11/1994 | Schuler et al. | |

(Continued)

FOREIGN PATENT DOCUMENTS

EP 0 191 203 A2 8/1988

(Continued)

OTHER PUBLICATIONS

Report No. 3709/10024, O. D. Oglesby, 'Extending Hairs With Controlled Forces', 15 Pages, 8 Figures, 1 Table, 6 Plates, date unknown.

(Continued)

*Primary Examiner* — Hwei-Siu C Payer
(74) *Attorney, Agent, or Firm* — Austin P. Wang; Kevin C. Johnson; Steven C. Miller

(57) ABSTRACT

Cutting members for razors are provided that have been subjected to a localized heat-treating process, e.g., application of laser energy. In some cases, the cutting members include a bent portion, and the localized heat-treating process is used to enhance ductility and thereby facilitate formation of the bent portion.

10 Claims, 6 Drawing Sheets

U.S. PATENT DOCUMENTS

| | | | | |
|---|---|---|---|---|
| 5,488,774 | A | 2/1996 | Janowski | |
| 5,522,137 | A | 6/1996 | Andrews | |
| 5,532,495 | A | 7/1996 | Bloomquist et al. | |
| 5,546,660 | A | 8/1996 | Burout et al. | |
| 5,575,185 | A | 11/1996 | Cox et al. | |
| 5,630,275 | A | 5/1997 | Wexler | |
| 5,906,053 | A | 5/1999 | Turner et al. | |
| 6,055,731 | A | 5/2000 | Zucker | |
| 6,077,572 | A | 6/2000 | Hopwood et al. | |
| 6,082,007 | A | 7/2000 | Andrews | |
| 6,156,435 | A | 12/2000 | Gleason et al. | |
| 6,161,287 | A | 12/2000 | Swanson et al. | |
| 6,161,288 | A | 12/2000 | Andrews | |
| 6,173,498 | B1 * | 1/2001 | Warrick et al. | 30/50 |
| 6,178,852 | B1 | 1/2001 | Pfaff | |
| 6,243,951 | B1 | 6/2001 | Oldroyed | |
| 6,289,593 | B1 | 9/2001 | Decker et al. | |
| 6,295,734 | B1 | 10/2001 | Gilder et al. | |
| 6,335,506 | B2 | 1/2002 | Christmas et al. | |
| 6,353,204 | B1 | 3/2002 | Spaay et al. | |
| 6,442,840 | B2 | 9/2002 | Zuker | |
| 6,468,642 | B1 | 10/2002 | Bray et al. | |
| 6,511,559 | B2 | 1/2003 | Brenner et al. | |
| 6,534,131 | B1 | 3/2003 | Domoto et al. | |
| 6,612,204 | B1 | 9/2003 | Droese et al. | |
| 6,804,886 | B2 * | 10/2004 | Wain | 30/49 |
| 2001/0013174 | A1 | 8/2001 | Zucker | |
| 2001/0015348 | A1 | 8/2001 | Christmas et al. | |
| 2002/0066186 | A1 | 6/2002 | White et al. | |
| 2002/0100522 | A1 | 8/2002 | Benton et al. | |
| 2003/0094077 | A1 | 5/2003 | Hoffman | |
| 2003/0204954 | A1 * | 11/2003 | Wain | 30/49 |
| 2004/0187644 | A1 | 9/2004 | Peterlin et al. | |
| 2005/0198828 | A1 | 9/2005 | Pennella | |
| 2007/0124939 | A1 * | 6/2007 | Van Eibergen Santhagens | 30/50 |
| 2007/0234576 | A1 * | 10/2007 | Masek et al. | 30/346.54 |
| 2010/0107425 | A1 * | 5/2010 | Bykowski et al. | 30/346.55 |

FOREIGN PATENT DOCUMENTS

| | | | |
|---|---|---|---|
| EP | 0591339 | B1 | 1/1993 |
| EP | 0 640 693 | A1 | 3/1995 |
| GB | 2055069 | A | 2/1981 |
| JP | 60165319 | A | 8/1985 |
| JP | 60258416 | A | 12/1985 |
| JP | 04263020 | A | 9/1992 |
| WO | WO 92/19425 | | 11/1992 |
| WO | WO 95/04637 | A1 | 2/1995 |
| WO | WO 2004/112986 | A1 | 12/2004 |

OTHER PUBLICATIONS

Report No. 3677/10024, O. D. Oglesby, 'Beard Hair Response to Applied Forces', 27 Pages, 11 Figures, 3 Tables, 3 Plates, dated Apr. 12, 1995.

* cited by examiner

CUTTING MEMBERS FOR SHAVING RAZORS

TECHNICAL FIELD

This invention relates to cutting members for shaving razors and methods of forming such cutting members.

BACKGROUND

Razor blades are typically formed of a suitable metallic sheet material such as stainless steel, which is slit to a desired width and heat-treated to harden the metal. The hardening operation utilizes a high temperature furnace, where the metal may be exposed to temperatures greater than 1145° C. for up to 18 seconds, followed by quenching.

After hardening, a cutting edge is formed on the blade. The cutting edge typically has a wedge-shaped configuration with an ultimate tip having a radius less than about 1000 angstroms, e.g., about 200-300 angstroms.

The razor blades are generally mounted on bent metal supports and attached to a shaving razor (e.g., a cartridge for a shaving razor). FIG. 1, for example, illustrates a prior art razor blade assembly that includes a planar blade 10 attached (e.g., welded) to a bent metal support 11. Blade 10 includes a tapered region 14 that terminates in a cutting edge 16. This type of assembly is secured to shaving razors (e.g., to cartridges for shaving razors) to enable users to cut hair (e.g., facial hair) with cutting edge 16. Bent metal support 11 provides the relatively delicate blade 10 with sufficient support to withstand forces applied to blade 10 during the shaving process. Examples of razor cartridges having supported blades are shown in U.S. Pat. No. 4,378,634 and in U.S. patent application Ser. No. 10/798,525, filed Mar. 11, 2004, which are incorporated by reference herein.

SUMMARY

In general, the invention features cutting members that have been subjected to a localized heat-treating process, and methods of forming such cutting members. In some cases, the cutting members include a bent portion, and the localized heat-treating process is used to increase ductility and thereby facilitate formation of the bent portion.

In one aspect, the invention features a razor blade having an edge portion with a cutting edge and a further portion, the edge portion being bent relative to the further portion in a bending zone spaced from the cutting edge, characterized in that at least the edge portion has a material structure hardened by a first heat treatment and in that the bending zone has a locally re-heated structure.

In another aspect, the invention features a razor blade comprising a blade body having an edge portion with a cutting edge, wherein the cutting edge has a hardness that is greater than the hardness of a portion of the blade body, the cutting edge having been locally hardened by a selective heat treatment.

In yet another aspect, the invention features a razor blade comprising an edge portion and a further portion, the edge portion having a cutting edge region terminated at a free end thereof and an opposing non-cutting edge region, the edge portion being bent relative to the further portion in a bending zone spaced from the cutting edge region and adjacent to the non-cutting edge region, characterized in that at least the edge portion has a material structure hardened by a heat treatment and in that the bending zone has a locally re-heated structure, wherein a thickness of the bending zone is less than that of the further portion and the non-cutting edge region.

In still another aspect, the invention features a razor blade comprising an edge portion and a further portion, the edge portion having a cutting edge region terminated at a free end thereof and an opposing non-cutting edge region, the edge portion being bent relative to the further portion in a bending zone spaced from the cutting edge region and adjacent to the non-cutting edge region, characterized in that at least the edge portion has a material structure hardened by a heat treatment and in that the bending zone has a locally re-heated structure, wherein a thickness of the bending zone is less than that of the non-cutting edge region.

Some implementations of these aspects of the invention include one or more of the following features. The heat treatment used to harden the edge portion may be a laser heat treatment. The locally re-heated structure may be re-heated using laser energy. The locally re-heated structure may have a ductility of about nine percent to about ten percent. The cutting edge may have a hardness of about 540 HV to about 750 HV, e.g., about 620 HV to about 750 HV.

In a further aspect, the invention features a method including (a) hardening at least a portion of a continuous strip of blade steel; (b) sharpening an edge region of the hardened strip to form a sharpened edge; (c) locally re-heating a portion of the strip spaced from the sharpened edge; (d) deforming the strip to form a bent portion; and then (e) separating the continuous strip into multiple discrete blades, each blade having a first portion, a second portion, with the bent and a bent portion being intermediate the first and second portions.

Some implementations include one or more of the following features. The locally re-heating step may include applying laser energy to the strip. The hardening step may include applying laser energy to the edge region of the strip. Deforming the continuous strip of material may include pressing the strip of material between a punch and a die. The laser energy may be applied substantially only to a region of the strip that is deformed to form the bent portion of the blades. The ductility of the locally re-heated portion of the continuous strip, after local re-heating, may be about nine percent to about ten percent elongation. The method may further include heat-treating a second edge region of the continuous strip opposite the first edge region to reduce sweep in the blades.

In yet another aspect, the invention features a method including locally hardening an edge region of a continuous strip of blade steel, without hardening a region of the strip spaced from the edge region, and sharpening the edge region of the hardened strip to form a sharpened edge.

The details of one or more embodiments of the invention are set forth in the accompanying drawings and the description below. Other features and advantages of the invention will be apparent from the description and drawings, and from the claims.

DETAILED DESCRIPTION

A preferred cutting member which may be formed by a method that includes a localized heat-treating process, and a razor containing the cutting member, will first be described with reference to FIGS. 2A-3.

Figure 2A:
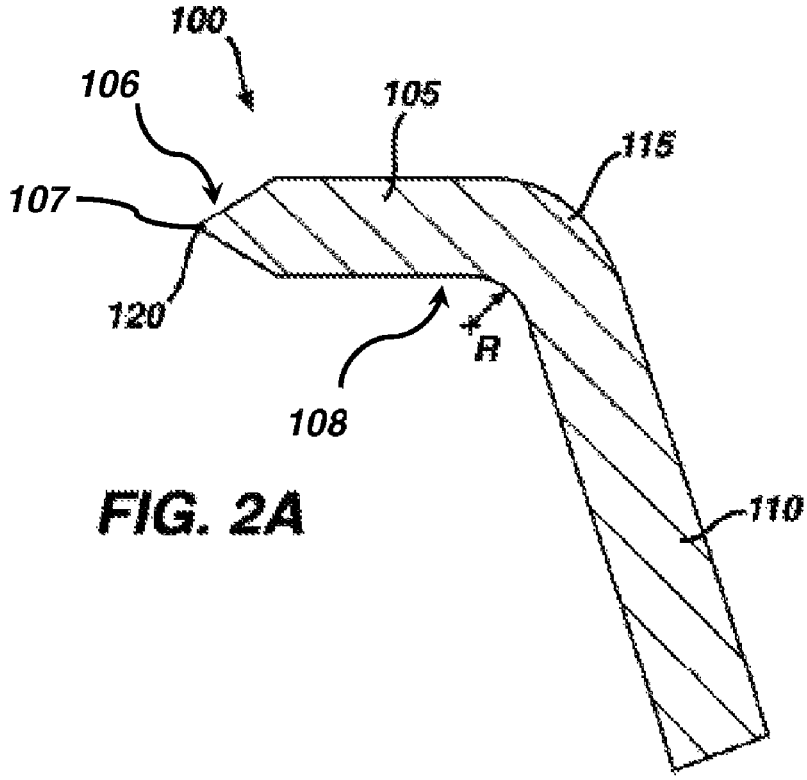
FIG. 2A is a cross-sectional view of an embodiment of a bent cutting member for a shaving razor.

Referring to FIG. 2A, a cutting member 100 includes a blade portion 105, a base portion 110, and a bent portion 115 that interconnects blade and base portions 105, 110. Blade portion 105 includes a cutting edge region 106 that terminates in a relatively sharp cutting edge 120 at a free end 107 thereof and an opposing non-cutting edge region 108, while base portion 110 terminates in a relatively blunt end region. The non-cutting edge region 108 of the blade portion 105 is adjacent to the bent portion 115. Typically, blade portion 105 of cutting member 100 has a length of about 0.032 inch (0.82 millimeters) to about 0.059 inch (1.49 millimeters). Base portion 110 has a length of about 0.087 inch (2.22 millimeters) to about 0.093 inch (2.36 millimeters). Bent portion 115 has a bend radius R of about 0.020 inch (0.45 millimeter) or less (e.g., about 0.012 inch (0.30 millimeter)). Relative to base portion 110, blade portion 105 extends at an angle of about 115 degrees or less (e.g., about 108 degrees to about 115 degrees, about 110 to about 113 degrees). Cutting edge 120 of blade portion 105 has a wedge-shaped configuration with an ultimate tip having a radius less than about 1000 angstroms (e.g., from about 200 to about 300 angstroms).

Figure 1:
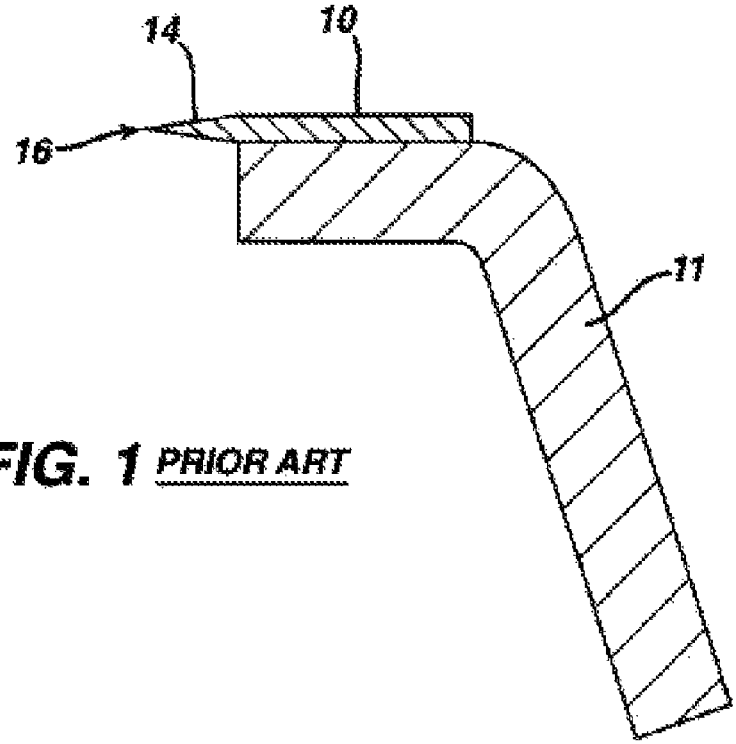
FIG. 1 PRIOR ART
FIG. 1 is a cross-sectional view of a prior art razor blade assembly including a planar cutting member attached to a bent support.
Figure 2B:
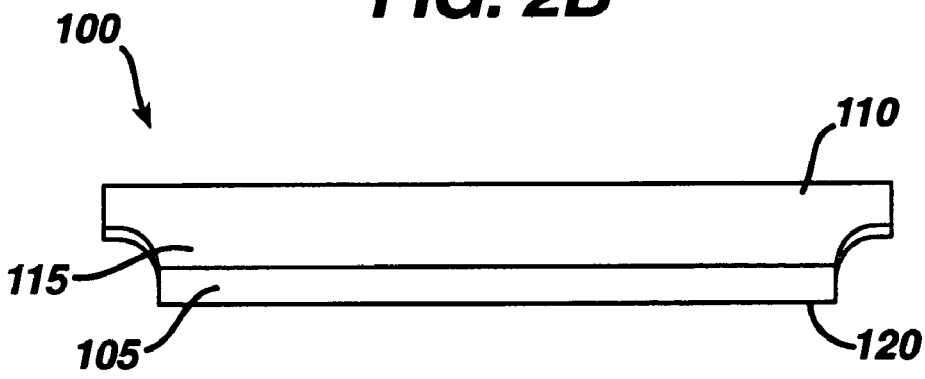
FIG. 2B is a top view of the cutting member of FIG. 2A.
Figure 2C:
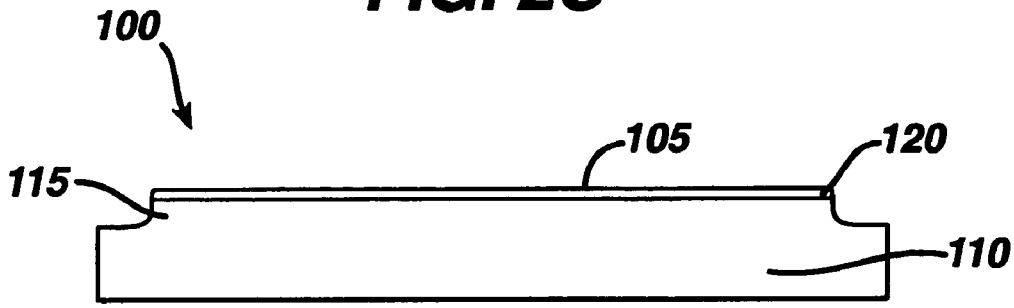
FIG. 2C is a front view of the cutting member of FIG. 2A.
Figure 3:
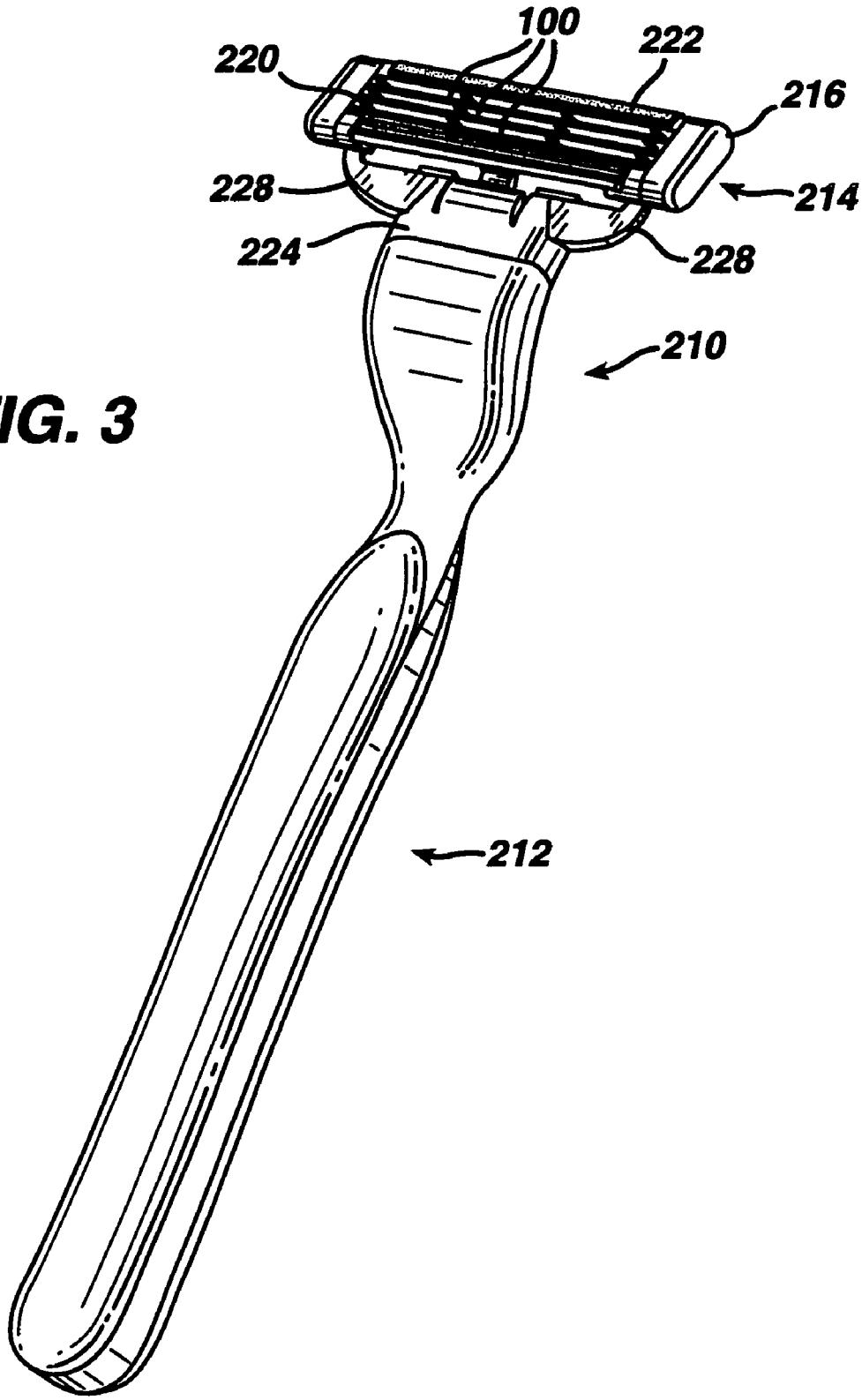
FIG. 3 illustrates a shaving razor that includes the bent cutting member of FIG. 2A.

As shown in FIG. 3, cutting member 100 can be used in shaving razor 210, which includes a handle 212 and a replaceable shaving cartridge 214. Cartridge 214 includes housing 216, which carries three cutting members 100, a guard 220, and a cap 222. In other embodiments, the cartridge may include fewer or more blades. Cutting members 100 can be mounted within cartridge 214 without the use of additional supports (e.g., without the use of bent metal supports like the one shown in FIG. 1). Cutting members 100 are captured at their ends and by a spring support under the blade portion 105. The cutting members are allowed to move, during shaving, in a direction generally perpendicular to the length of blade portion 105. As shown in FIGS. 2A and 2B, the lower base portions 110 of cutting members 100 extend to the sides beyond the upper bent and blade portions 115, 105. The lower base portions 110 can be arranged to slide up and down within slots in cartridge housing 216 while the upper portion rests against resilient arms during shaving. The slots of the cartridge housing 216 have back stop portions and front stop portions that define, between them, a region in which cutting members 100 can move forward and backward as they slide up and down in the slots during shaving. The front stop portions are generally positioned beyond the ends of blade portions 105, so as not to interfere with movement of blade portions 105. Cutting members 100 are arranged within cartridge 214 such that cutting 120 are exposed. Cartridge 214 also includes an interconnect member 224 on which housing 216 is pivotally mounted at two arms 228. When cartridge 214 is attached to handle 212 (e.g., by connecting interconnect member 224 to handle 212), as shown in FIG. 3, a user can move the relatively flat face of cartridge 214 across his/her skin in a manner that permits cutting edges 120 of cutting members 100 to cut hairs extending from the user's skin.

Figure 4:
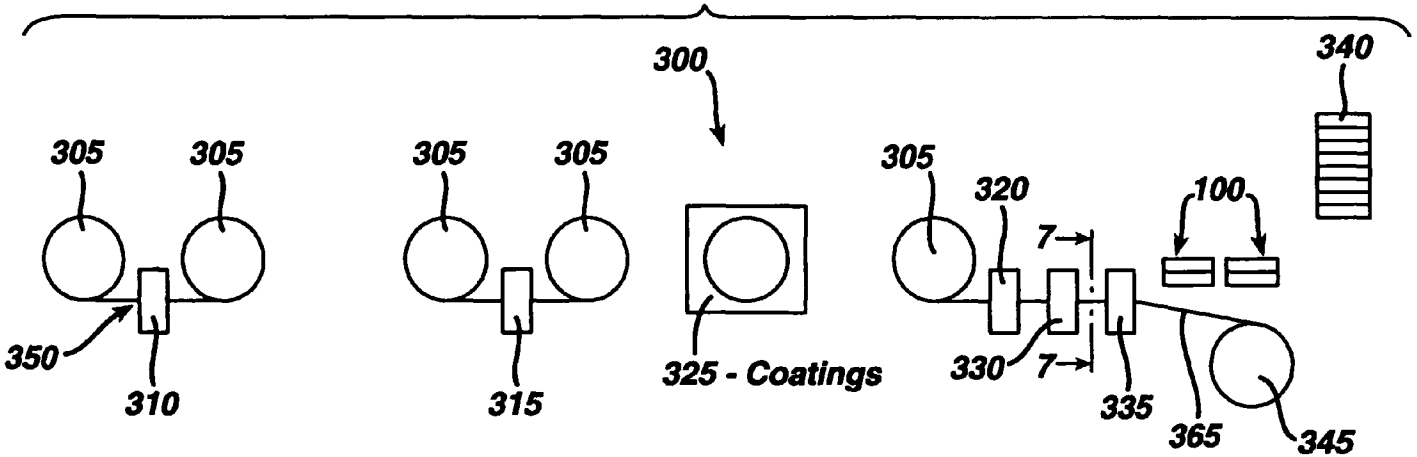
FIG. 4 illustrates a method and apparatus for forming the cutting member of FIG. 2A.
Figure 5:
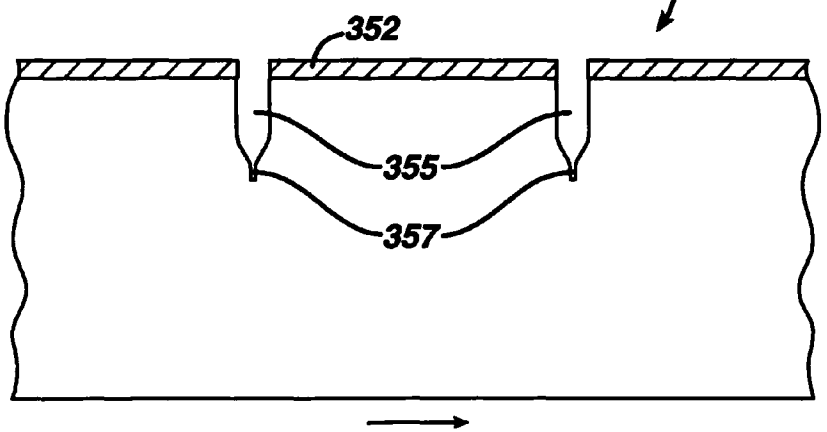
FIG. 5 is a partial top view of a strip of blade steel after exiting a cutting device of the apparatus shown in FIG. 4.
Figure 6:
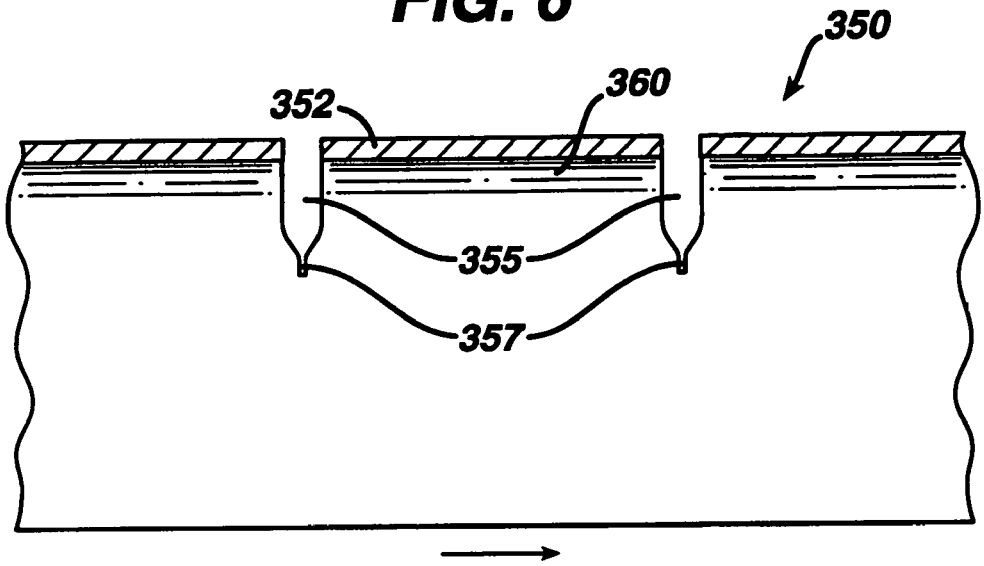
FIG. 6 is a partial top view of the strip of blade steel after exiting a bending device of the apparatus shown in FIG. 4.
Figure 7:
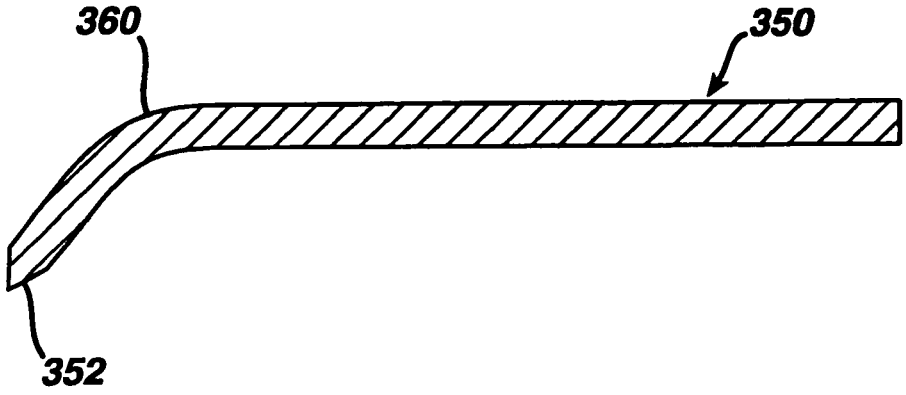
FIG. 7 is a cross-sectional view of the strip of blade steel taken along line 7-7 in FIG. 4.

FIG. 4 shows a method and apparatus 300 for forming cutting members 100. A continuous strip of blade steel 350 is conveyed (e.g., pulled by a rotating roll from a roll 305 of blade steel to a heat-treating device 310 (which may comprise multiple heat-treating devices), where strip 350 is heat-treated to increase the hardness and/or increase the ductility of discrete regions of the blade strip. Strip 350 is then re-coiled into a roll 305 of hardened blade steel, and subsequently unwound and conveyed to a sharpening device 315, where the hardened edge region of the strip is sharpened to form a cutting edge 352. Strip 350 is again re-coiled into a roll 305 of heat treated and sharpened blade steel, after which it is coated with hard and lubricious coatings using a coating device 325. Strip 350 is then unwound and conveyed to a cutting/stamping station which includes a cutting device 320. Cutting device 320 creates transverse slots 355 and adjoining slits 357 (FIG. 5) across longitudinally spaced apart regions of strip 350 (as shown in FIG. 5). Strip 350 is then conveyed to a bending device 330, within the cutting/stamping station, that creates a longitudinal bend 360 in the regions of strip 350 between transverse slots 355 (shown in FIGS. 6 and 7). After being bent, strip 350 is separated into multiple, discrete cutting members 100 by a separating device 335, also within the cutting/stamping station. Cutting members 100 may then be arranged in a stack 340 for transport and/or for further processing, or assembled directly into cartridges, and a scrap region 365 of strip 350 is assembled onto roll 345 for recycling or disposal. Scrap region 365, for example, can be used merely to help convey strip 350 through the blade forming devices described above. Alternatively or additionally, any of various other techniques can be used to convey strip 350 through the blade forming devices.

In certain embodiments, heat-treating device 310 is a laser device. The laser device can be used to locally harden a discrete region of strip 350 (e.g., the edge region of strip 350). For example, laser energy (e.g., laser light) from the laser device can be directed to the strip as the strip is conveyed from the roll to the sharpening device. Strip 350 can be conveyed at a rate of about 5 ft/min (1.5 m/min) to about 200 ft/min (61 m/min) (e.g., about 120 ft/min (36.6 m/min)). Generally, the power of the laser device is directly proportional to the rate at which strip 350 is conveyed. In some embodiments, the laser device is configured to produce energy at about 100 watts to about one kilowatt (e.g., about 200 watts). The light emitted from the laser device can have a wavelength of about 950 nm to about 1440 nm (e.g., about 1064 nm). The discrete region of the strip 350, which is contacted by the laser light, can reach a temperature of about 1050 degrees Celsius to about 1400 degrees Celsius (e.g., about 1200 degrees Celsius). The time for which the discrete region of strip 350 is heated depends on the power level of the laser device. Typically, the time for which the discrete region of strip 350 is heated decreases as the power level of the laser device increases, and vice versa. The laser energy can, for example, be applied to the discrete region of strip 350 for about 0.010 seconds to about 0.190 seconds. The hardness of the heated region of strip 350 can be increased as a result of the heat-treatment. The heated region of strip 350 can, for example, have a hardness of about 540 HV to about 750 HV (e.g., about 620 HV to about 750 HV).

While heat-treating device 310 has been described as a laser device, any of various other devices capable of locally treating discrete regions of strip 350 can be used. For example, the heat-treating device can include an induction coil that is arranged about a portion of strip 350 to heat, and thus harden, that portion of strip 350.

Moreover, the heat-treating device 310 may include multiple heat-treating devices, for example one or more heat-treating devices configured to heat the entire strip, and one or more heat-treating devices configured for localized heating. For instance, heat-treating device 310 may include a traditional furnace configured to heat the entire strip, followed by a laser configured for localized heating. In this case, the conventional furnace would impart hardness to the entire strip, and then the laser would generally be used to temper or soften a localized area of the strip, e.g., the bend area, to increase ductility.

Due to its relatively small area, the heated region of strip 350 generally self-quenches after being exposed to the laser energy. Alternatively or additionally, a cooling source (e.g., a cooling fluid) can be applied to the heated region of the strip to aid the quenching process.

Sharpening device 315 can be any device capable of sharpening the edge of strip 350. Examples of razor blade cutting edge structures and processes of manufacture are described in U.S. Pat. Nos. 5,295,305; 5,232,568; 4,933,058; 5,032,243; 5,497,550; 5,940,975; 5,669,144; EP 0591339; and WO 92/19425, which are hereby incorporated by reference.

Cutting device 320 can be any of various devices capable of providing slots 355 and/or slits 357 in strip 350. In some embodiments, cutting device is a punch press. In such embodiments, the progression of strip 350 can be periodically paused in order to allow the punch press to stamp slots 355 and/or slits 357 in strip 350. Cutting device 320 can alternatively or additionally be any of various other devices, such as a high power laser or a scoring operation followed by a bending or fracturing operation.

Referring again to FIG. 5, after strip 350 has been conveyed through cutting device 320, strip 350 includes multiple, longitudinally spaced apart slots 355 that extend inwardly from the sharpened edge of the strip to a central region of the strip. Slits 357 extend inwardly from slots 355. Slots 355 are spaced apart by a distance that corresponds to the width of cutting members 100. In some embodiments, adjacent slots 355 are spaced apart from one another by about 36.20 millimeters to about 36.50 millimeters. In certain embodiments, adjacent slits are spaced apart from one another by about 37.26 millimeters to about 37.36 millimeters. By providing discrete regions that are separated by slots 355, the bending of strip 350 can be improved.

Figure 8A:
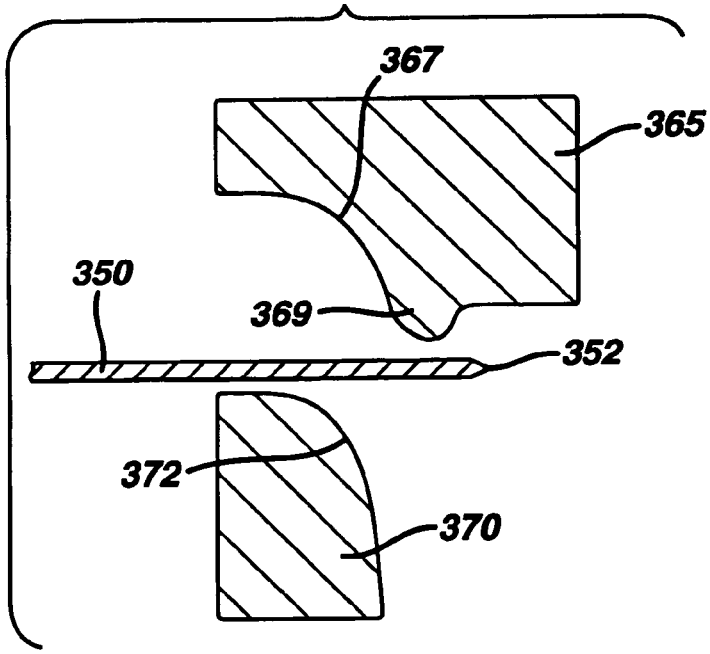
FIGS. 8A and 8B illustrate an embodiment of a method of forming a bent region in the strip of blade steel.
Figure 8B:
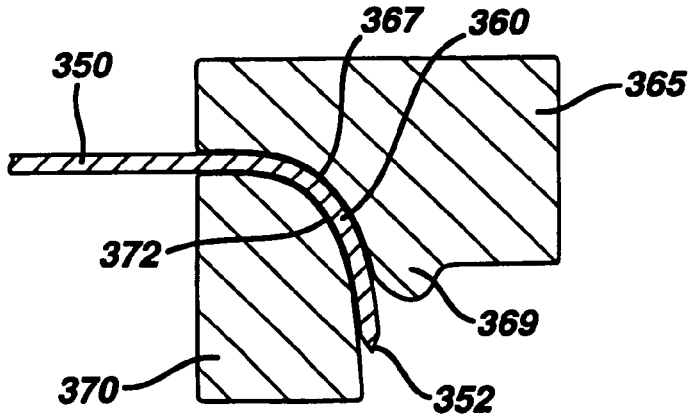

Bending device 330 can be any device capable of forming a longitudinal bend in strip 350. In some embodiments, as shown in FIGS. 8A and 8B, bending device 330 is an assembly that includes a punch 365 and a die 370. Punch 365 includes a curved portion 367 that is configured to mate with an associated curved portion 372 of die 370. Generally, curved portion 367 of punch 365 has a radius that is slightly larger than a radius of curved portion 372 of die 370. Curved portion 367 of punch 365, for example can have a radius of about 0.0231" to about 0.0241", while curved portion 372 of die 370 can have a radius of about 0.010" to about 0.014". Punch 365 also includes a protrusion 369 that is configured to contact a portion of strip 350 that, as discussed below, is offset from sharpened edge 352 of strip 350.

To form bent region 360 of strip 350, the relatively planar strip 350 is positioned between punch 365 and die 370, as shown in FIG. 8A. Punch 365 and die 370 are then moved toward one another such that curved portions 367 and 372 generally mate. Punch 365 can, for example, be moved toward die 370 at a rate of about 25 ft/min (10 m/min) to about 500 ft/min (200 m/min). As punch 365 and die 370 are moved toward one another, protrusion 369 of punch 365 contacts a region of strip 350 offset from sharpened edge 352. As punch 365 and die 370 mate with one another, strip 350 is deformed into a bent position between punch 365 and die 370. Due to the configuration of punch 365 and die 367, sharpened edge 352 can remain untouched throughout the bending process. This arrangement can help to prevent damage to the relatively delicate, sharpened edge 352 of strip 350.

As a result of the bending process, the thickness of strip 350 in bent region 360 can be reduced, relative to the thickness of strip 350 prior to being bent, by at least about five percent (e.g., about five percent to about 30 percent). Strip 350 in bent region 360, for example, can have a thickness of about 0.0035 inch (0.089 millimeter) to about 0.0095 inch (0.241 millimeter), while the remainder of strip 350 can have a thickness of about 0.005 inch (0.127 millimeter) to about 0.01 inch (0.254 millimeter).

Separating device 335 can be any device capable of separating the regions of strip 350 between slots 355 from the remainder of strip 350 to form discrete cutting members 100. In some embodiments, separating device 335 is a punch press. The progression of strip 350 can be periodically paused to allow the punch press to accurately separate the regions of strip 350 between slots 355 from the remainder of strip 350 to form cutting members 100.

Other devices capable of separating the regions of strip 350 between slots 355 from the remainder of strip 350 can alternatively or additionally be used. Examples of such devices include a high power laser or a scoring operation followed by a bending or fracturing operation.

The cutting member may have certain preferred characteristics, as will now be described.

In certain embodiments, cutting member 100 is relatively thick, as compared to many conventional razor blades. Cutting member 100, for example, can have an average thickness of at least about 0.003 inch (0.076 millimeter), e.g., about 0.005 inch (0.127 millimeter) to about 0.01 inch (0.254 millimeter). As a result of its relatively thick structure, cutting member 100 can provide increased rigidity, which can improve the comfort of the user and/or the cutting performance of cutting member 100 during use. In some embodiments, cutting member 100 has a substantially constant thickness. For example, blade portion 105 (except for cutting edge 120), base portion 110, and bent portion 115 can have substantially the same thickness.

In some embodiments, the thickness of bent portion 115 is less than the thickness of blade portion 105 and/or base portion 110. For example, the thickness of bent portion 115 can be less than the thickness of blade portion 105 and/or base portion 110 by at least about five percent (e.g., about five percent to about 30 percent, about ten percent to about 20 percent).

In certain embodiments, cutting member 100 (e.g., base portion 110 of cutting member 100) has a hardness of about 540 HV to about 750 HV (e.g., about 540 HV to about 620 HV). In some embodiments, bent portion 115 has a hardness that is less than the hardness of base portion 110. Bent portion 115 can, for example, have a hardness of about 540 HV to about 620 HV. The hardness of cutting member 100 can be measured by ASTM E92-82—Standard Test Method for Vickers Hardness of Metallic Materials. In certain embodiments, cutting member 100 has a substantially uniform hardness. In other embodiments, cutting edge 120 is harder than the other portions of cutting member 100.

In some embodiments, cutting member 100 (e.g., bent portion 115 of cutting member 100) has a ductility of about seven percent to about 12 percent (e.g., about nine percent to about ten percent) elongation measured in uniaxial tension at fracture. The ductility of bent portion 115 can be measured, for example, by ASTM E345-93—Standard Test Methods of Tension Testing of Metallic Foil. In some embodiments, bent portion 115 and the remainder of cutting member 100 have substantially the same ductility. In certain embodiments, bent portion 115 has greater ductility than the other portions of cutting member 100.

Cutting member 100 can be formed of any of various suitable materials, including GIN6 and GINB steels and other blade steels. In certain embodiments, cutting member 100 is formed of a material having a composition comprised of about 0.35 to about 0.43 percent carbon, about 0.90 to about 1.35 percent molybdenum, about 0.40 to about 0.90 percent manganese, about 13 to about 14 percent chromium, no more than about 0.030 percent phosphorus, about 0.20 to about 0.55 percent silicon, and no more than about 0.025 percent sulfur. Cutting member 100 can, for example, be formed of a stainless steel having a carbon content of about 0.4 percent by weight, a chromium content of about 13 percent by weight, a molybdenum content of about 1.25 percent by weight, and amounts of manganese, chromium, phosphorus, silicon and sulfur within the above ranges.

In some embodiments, blade portion 105 and/or base portion 110 have minimal levels of bow and sweep. Bow is a term used to describe an arching normal to the plane in which the portion of the cutting member is intended to lie. Sweep, also commonly referred to as camber, is a term used to describe an arching within the plane in which the portion of the cutting member lies (e.g., an arching of the longitudinal edges of the portion of the cutting member). In some embodiments, blade portion 105 has a bow of about +0.0004 to about −0.002 inch (+0.01 to −0.05 millimeter) or less across the length of the blade portion. In certain embodiments, blade portion 105 has a sweep of about ±0.0027 inch (±0.07 millimeter) or less across the length of the blade portion. Base portion 110 can have a bow of about ±0.0024 inch (±0.060 millimeter) or less across the length of the base portion. By reducing the levels of bow and/or sweep in blade portion 105 and/or base portion 110, the comfort of the user and/or the cutting performance of cutting member 100 can be improved.

While certain embodiments have been described, other embodiments are possible.

For example, the localized heat-treating processes described above can be used to heat treat blades other than the bent blades described above. For instance, a localized heat-treating process can be used to locally harden the edge of a conventional blade such as the prior art razor blades described above with reference to FIG. 1.

Moreover, the order of many of the process steps discussed above can be altered. The process steps can be ordered in any of various different combinations.

As another example, while heat-treating device 310 has been described as being configured to treat an edge region of strip 350, heat treating device 310 can alternatively or additionally be arranged to treat additional regions of strip 350 (e.g., regions of strip 350 that are not intended to be sharpened by sharpening device 315). In some embodiments, for example the entire strip 350 is hardened by heat-treating device 310.

As a further example, while increasing the ductility of a region of strip 350 that is to be bent has been described above, additional or other regions of strip 350 (e.g., regions of strip 350 that are not intended to be bent by bending device 330) may be heat-treated to increase ductility. In certain embodiments, for example, substantially the entire strip 350 is heat-treated to increase its ductility. In some embodiments, as noted above, strip 350 is conveyed through a heat treating device to harden substantially the entire strip. After initially hardening substantially the entire strip an edge region of strip 350 is sharpened as described above. Then, strip 350 is subjected to heat treating to increase the ductility of substantially the entire strip, which can help to improve the bending of strip 350. Strip 350 can then be further processed as discussed above.

As another example, while the embodiments above describe heat-treating a discrete region of strip 350 to increase the ductility of that region, in certain embodiments, the cutting member forming process can be carried out without this heat-treating step. In such embodiments, strip 350 can be formed of a relatively ductile material. Strip 350 can be conveyed through heat-treating device 310 to locally harden an edge region of strip 350 so that the edge region can be sharpened. After being sharpened, strip 350 can be cut and bent without first heat-treating the bend region. The material from which strip 350 is formed, for example, can be sufficiently ductile so that the second heat-treating step is not required to prevent damage to the strip as a result of the bending process. After bending strip 350, the remainder of the process can be carried out in accordance with the description herein.

As an additional example, in some embodiments, a heating device is configured to apply heat to both longitudinal edges of strip 350. For example, one of the longitudinal edges can be heat-treated, as discussed above, in order to harden the region for sharpening, and the opposing longitudinal edge can be heat treated to reduce (e.g., to prevent) sweep within strip 350. For example, the opposing longitudinal edge can be heat-treated to substantially the same temperature as edge 352. In some embodiments, the regions that are heat-treated are symmetrical with respect to a center line of strip 350.

Other embodiments are within the scope of the claims.

What is claimed is:

1. A razor blade comprising an edge portion and a further portion, the edge portion having a cutting edge region terminated at a free end thereof and an opposing non-cutting edge region, the edge portion being bent relative to the further portion in a bending zone spaced from the cutting edge region and adjacent to the non-cutting edge region, characterized in that at least the edge portion has a material structure hardened by a heat treatment and in that the bending zone has a locally re-heated structure, wherein a thickness of the bending zone is less than that of the further portion and the non-cutting edge region.

2. The razor blade of claim 1 wherein the heat treatment used to harden the edge portion comprises a laser heat treatment.

3. The razor blade of claim 1 or 2 wherein the locally re-heated structure has been re-heated using laser energy.

4. The razor blade of claim 1 wherein the locally re-heated structure has a ductility of about nine percent to about ten percent.

5. The razor blade of claim 4 wherein the cutting edge region has a hardness of about 540 HV to about 750 HV.

6. A razor blade comprising an edge portion and a further portion, the edge portion having a cutting edge region terminated at a free end thereof and an opposing non-cutting edge region, the edge portion being bent relative to the further portion in a bending zone spaced from the cutting edge region and adjacent to the non-cutting edge region, characterized in that at least the edge portion has a material structure hardened by a heat treatment and in that the bending zone has a locally re-heated structure, wherein a thickness of the bending zone is less than that of the non-cutting edge region.

7. The razor blade of claim 6 wherein the heat treatment used to harden the edge portion comprises a laser heat treatment.

8. The razor blade of claim 6 or 7 wherein the locally re-heated structure has been re-heated using laser energy.

9. The razor blade of claim 6 wherein the locally re-heated structure has a ductility of about nine percent to about ten percent.

10. The razor blade of claim 9 wherein the cutting edge region has a hardness of about 540 HV to about 750 HV.

* * * * *